US011721472B2

(12) United States Patent
Zheng et al.

(10) Patent No.: US 11,721,472 B2
(45) Date of Patent: Aug. 8, 2023

(54) COIL COMPONENT, CIRCUIT BOARD, AND POWER SUPPLY DEVICE

(71) Applicant: SUMITOMO ELECTRIC INDUSTRIES, LTD., Osaka (JP)

(72) Inventors: Xiaoguang Zheng, Osaka (JP); Kazushi Kusawake, Osaka (JP); Masayoshi Hirota, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 419 days.

(21) Appl. No.: 16/648,266

(22) PCT Filed: Aug. 22, 2018

(86) PCT No.: PCT/JP2018/031031
§ 371 (c)(1),
(2) Date: Mar. 18, 2020

(87) PCT Pub. No.: WO2019/082489
PCT Pub. Date: May 2, 2019

(65) Prior Publication Data

US 2020/0227200 A1 Jul. 16, 2020

(30) Foreign Application Priority Data

Oct. 25, 2017 (JP) ..... JP2017-206159

(51) Int. Cl.
*H01F 27/28* (2006.01)
*H01F 27/26* (2006.01)
*H01F 30/12* (2006.01)

(52) U.S. Cl.
CPC ..... *H01F 27/26* (2013.01); *H01F 27/28* (2013.01); *H01F 30/12* (2013.01)

(58) Field of Classification Search
CPC ..... H01F 27/26; H01F 27/28; H01F 30/12; H01F 3/14
See application file for complete search history.

(56) References Cited

U.S. PATENT DOCUMENTS 5,053,738 A * 10/1991 Sato ..... H01F 38/10 336/215
5,812,045 A * 9/1998 Ishikawa ..... H01F 5/02 336/83

(Continued)

FOREIGN PATENT DOCUMENTS

CN 1316173 A 10/2001
JP 2001-223122 A 8/2001

(Continued)

OTHER PUBLICATIONS

Oct. 23, 2018 International Search Report issued in International Patent Application No. PCT/JP2018/031031.

*Primary Examiner* — Tuyen T Nguyen
(74) *Attorney, Agent, or Firm* — Oliff PLC

(57) ABSTRACT

A coil component used for two-phase transformer coupling includes: a first coil and a second coil; and a magnetic core at which the first coil and the second coil are provided. The magnetic core includes: a first magnetic leg at which the first coil is provided; a second magnetic leg at which the second coil is provided; a central leg portion interposed between the first magnetic leg and the second magnetic leg; a pair of connection portions connecting the first magnetic leg, the central leg portion, and the second magnetic leg in parallel; a main gap interposed in the central leg portion; a first gap interposed in the first magnetic leg; and a second gap interposed in the second magnetic leg. A coupling coefficient between the first coil and the second coil is not less than 0.7.

9 Claims, 7 Drawing Sheets

(56) References Cited

U.S. PATENT DOCUMENTS

| | | | | |
|---|---|---|---|---|
| 6,449,178 | B1 | 9/2002 | Sakai et al. | |
| 7,880,577 | B1 * | 2/2011 | Glaser | H02M 7/103 323/308 |
| 2008/0303624 | A1 | 12/2008 | Yamada et al. | |
| 2013/0200975 | A1 * | 8/2013 | Shudarek | H01F 27/28 336/170 |
| 2015/0070942 | A1 | 3/2015 | Terui et al. | |

FOREIGN PATENT DOCUMENTS

| | | | | | |
|---|---|---|---|---|---|
| JP | 2003143852 | A | * | 5/2003 | |
| JP | 2006-262680 | A | | 9/2006 | |
| JP | 2009-016797 | A | | 1/2009 | |
| JP | 2009206178 | A | * | 9/2009 | |
| JP | 2012-065453 | A | | 3/2012 | |
| JP | 2013-198211 | A | | 9/2013 | |
| JP | 2015-023158 | A | | 2/2015 | |
| WO | WO-2008097758 | A1 | * | 8/2008 | H01F 37/00 |

* cited by examiner

COIL COMPONENT, CIRCUIT BOARD, AND POWER SUPPLY DEVICE

TECHNICAL FIELD

The present invention relates to a coil component, a circuit board, and a power supply device.

This application claims priority on Japanese Patent Application No. 2017-206159 filed on Oct. 25, 2017, the entire content of which is incorporated herein by reference.

BACKGROUND ART

One example of a circuit provided in a DC-DC converter for performing boost operation is a transformer-coupled boost chopper circuit of two-phase type shown in FIG. 5 of PATENT LITERATURE 1. PATENT LITERATURE 1 discloses a coil component used in this circuit and including a magnetic core obtained by combining two E-shaped cores. This magnetic core 300 includes, as shown in FIG. 7, a first magnetic leg 310 at which a first coil 101 is provided, a second magnetic leg 320 at which a second coil 102 is provided, a central leg portion 330 located between both magnetic legs 310, 320, and a pair of connection portions 340, 340 sandwiching these in parallel. The central leg portion 330 includes a gap 330*g*.

CITATION LIST

Patent Literature

PATENT LITERATURE 1: Japanese Laid-Open Patent Publication No. 2013-198211

SUMMARY OF INVENTION

A coil component of the present disclosure is a coil component used for two-phase transformer coupling, the coil component including: a first coil and a second coil; and a magnetic core at which the first coil and the second coil are provided. The magnetic core includes: a first magnetic leg at which the first coil is provided; a second magnetic leg at which the second coil is provided; a central leg portion interposed between the first magnetic leg and the second magnetic leg; a pair of connection portions connecting the first magnetic leg, the central leg portion, and the second magnetic leg in parallel; a main gap interposed in the central leg portion; a first gap interposed in the first magnetic leg; and a second gap interposed in the second magnetic leg. A coupling coefficient between the first coil and the second coil is not less than 0.7.

A circuit board of the present disclosure includes the coil component of the present disclosure.

A power supply device of the present disclosure includes the circuit board of the present disclosure.

DESCRIPTION OF EMBODIMENTS

Problems to be Solved by the Present Disclosure

For the coil components used in two-phase transformer coupling described above, it is desired that magnetic saturation is less likely to occur.

Figure 7:
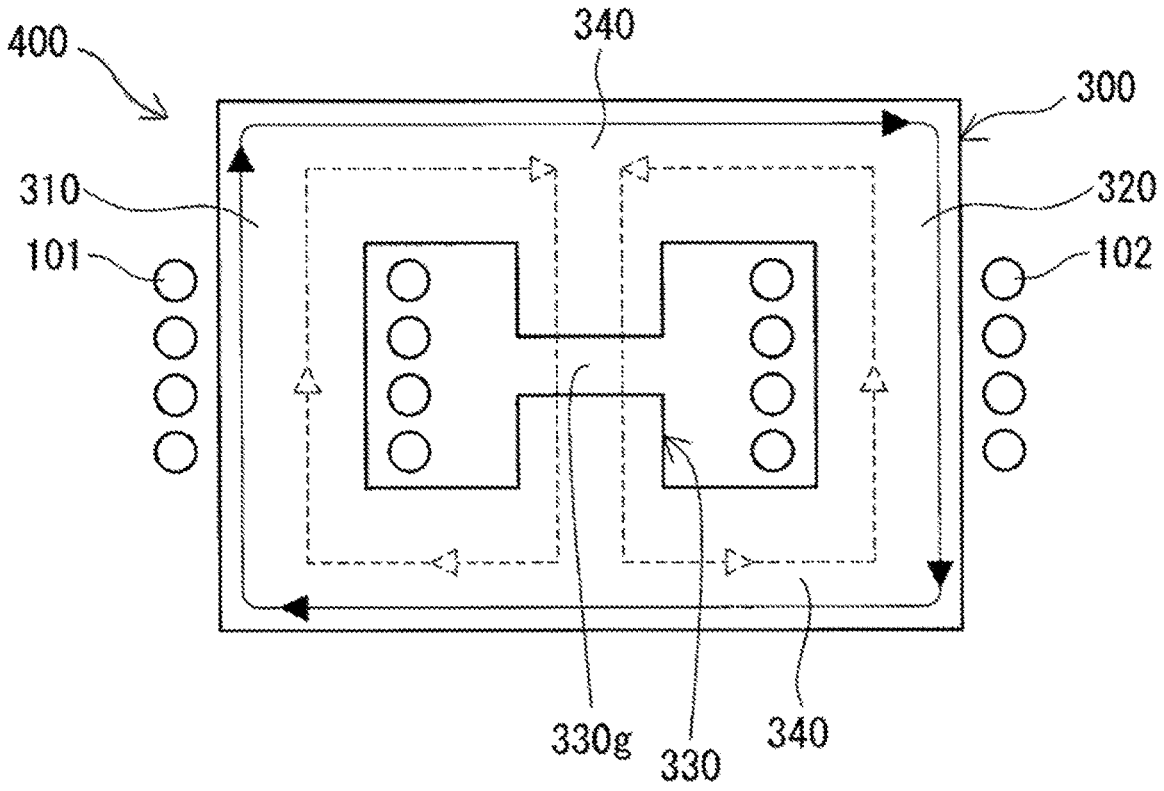
FIG. 7 shows a coil component not having gaps in a first magnetic leg and a second magnetic leg, and illustrates the state of a magnetic flux when coils provided at the respective magnetic legs are excited.

Circuit components such as switches are connected via a wiring pattern and the like to the first coil 101 and the second coil 102 described above. Due to manufacturing error in the wiring pattern and the circuit components, variation in connection conditions, or the like, a great difference can occur between currents flowing through the respective coils 101, 102. In the above magnetic core 300, there is a possibility that magnetic saturation is caused by the current difference. The reason will be described below. In FIG. 7, broken-line arrows indicate the state of a leakage magnetic flux when each coil 101, 102 is excited, and solid-line arrows indicate the state of an interlinkage magnetic flux.

In the coil component 400 shown in FIG. 7, the second coil 102 is provided at the second magnetic leg 320 of the magnetic core 300 so as to cancel, near the central leg portion 330, a magnetic flux generated by the first coil 101 provided at the first magnetic leg 310 of the magnetic core 300. A magnetic flux generated by a DC current flowing through each coil 101, 102 passes through a magnetic path passing from each magnetic leg 310, 320 through the central leg portion 330, as shown by broken-line arrows. That is, the central leg portion 330 mainly forms a magnetic path for a leakage magnetic flux (magnetic flux not interlinked). On the other hand, an interlinkage component of a magnetic flux due to varying voltages applied to both coils 101, 102 mainly passes through a magnetic path passing from one magnetic leg 310 through the other magnetic leg 320 without passing through the central leg portion 330, as shown by solid-line arrows. This magnetic path is a magnetic path of transformer coupling of both coils 101, 102. Where the number of turns of each coil 101, 102 is denoted by N and DC currents flowing through the respective coils 101, 102 are denoted by $I_1$, $I_2$, also a magnetic flux represented by $N\times(I_1-I_2)$ is to pass through the transformer coupling magnetic path, in addition to the above interlinkage magnetic flux. As is obvious from the above expression, as the current difference $(I_1-I_2)$ between the coils 101, 102 increases, the amount of the magnetic flux to pass through the transformer coupling magnetic path increases, so that the magnetic core 300 reaches magnetic saturation. When magnetic saturation occurs, predetermined voltage transforming operation such as boost operation or step-down operation cannot be performed.

For example, by increasing the sectional area of a magnetic path of a magnetic core, magnetic saturation can be suppressed. However, in this case, the size of the coil component increases. Alternatively, for example, by detecting a current difference and separately providing a control circuit for reducing the current difference, magnetic saturation due to the current difference can be made less likely to occur. However, in this case, the circuit configuration is complicated. Therefore, it is preferable that the coil component has a small size and a simple configuration and is less likely to cause magnetic saturation.

Considering the above, one object is to provide a coil component in which magnetic saturation is less likely to occur. Another object is to provide a circuit board and a power supply device in which magnetic saturation is less likely to occur.

Effects of the Present Disclosure

In the above coil component, magnetic saturation is less likely to occur. The above circuit board and the above power supply device enable predetermined voltage transforming operation to be favorably performed.

Description Of Embodiment Of The Present Disclosure

First, an embodiment of the present disclosure is listed and described.

(1) A coil component according to one mode of the present disclosure is a coil component used for two-phase transformer coupling, the coil component including: a first coil and a second coil; and a magnetic core at which the first coil and the second coil are provided. The magnetic core includes: a first magnetic leg at which the first coil is provided; a second magnetic leg at which the second coil is provided; a central leg portion interposed between the first magnetic leg and the second magnetic leg; a pair of connection portions connecting the first magnetic leg, the central leg portion, and the second magnetic leg in parallel; a main gap interposed in the central leg portion; a first gap interposed in the first magnetic leg; and a second gap interposed in the second magnetic leg. A coupling coefficient between the first coil and the second coil is not less than 0.7.

In the above coil component, in addition to the main gap, gaps are also provided to the magnetic legs at which the coils are provided. Therefore, in a case where there is substantially no difference between DC currents flowing through the respective coils, magnetic saturation due to excitation by the DC currents described above can be made less likely to occur, owing to the main gap. Further, even when a difference occurs between currents flowing through the respective coils, magnetic saturation due to the current difference can be made less likely to occur, owing to the gaps provided in the respective magnetic legs. Thus, the above coil component is less likely to cause magnetic saturation. In particular, the above coil component is less likely to cause magnetic saturation while having a simple structure in which gaps are provided in the respective magnetic legs.

In addition, in the above coil component, the gaps are provided in the respective magnetic legs within such a range that causes the coupling coefficient between both coils to be not less than 0.7. Therefore, increase in ripple current due to reduction of the coupling coefficient is small (see test example 1 described later), and thus the influence of ripple current on the entire circuit can be reduced. If the coil component as described above is used for a voltage transforming circuit such as a two-phase transformer-coupled boost/step-down circuit, magnetic saturation due to the above current difference is less likely to occur and increase in ripple current is small, and therefore predetermined voltage transforming operation can be favorably performed.

Further, the gaps provided in the respective magnetic legs can be made small (see the following configurations (2) and (3)), and thus it is not necessary to excessively increase the size of the magnetic core including the gaps. Accordingly, the above coil component has a small size.

(2) As an example, the above coil component may be configured such that each of a gap length of the first gap and a gap length of the second gap is shorter than a gap length of the main gap.

In the above configuration, since the gap lengths of the magnetic legs are shorter than that of the main gap, the coupling coefficient can be readily ensured to be great and increase in ripple current can be readily reduced. In addition, increase in the size of magnetic core including the gaps can be readily suppressed. Therefore, in the above configuration, magnetic saturation is less likely to occur, the influence of ripple current can be readily reduced, and size reduction can be achieved.

(3) As an example, the coil component of the above (2) may be configured such that each of the gap length of the first gap and the gap length of the second gap is not greater than 10% of the gap length of the main gap.

In the above configuration, the gap lengths of the magnetic legs are even shorter than that of the main gap. Therefore, in the above configuration, magnetic saturation is less likely to occur, the influence of ripple current can be more readily reduced, and further size reduction can be achieved.

(4) A circuit board according to one mode of the present disclosure includes the coil component according to any one of the above (1) to (3).

The above circuit board includes the above coil component in which magnetic saturation due to the current difference is less likely to occur and increase in ripple current is small. Therefore, if the above circuit board is used for a voltage transforming circuit such as a two-phase transformer-coupled boost/step-down circuit, predetermined voltage transforming operation can be favorably performed.

(5) A power supply device according to one mode of the present disclosure includes the circuit board according to the above (4).

The above power supply device includes the above circuit board provided with the above coil component in which magnetic saturation due to the current difference is less likely to occur and increase in ripple current is small. Therefore, if the above power supply device is used for a converter such as a two-phase transformer-coupled boost/step-down converter, predetermined voltage transforming operation can be favorably performed.

Details of Embodiment of the Present Disclosure

Hereinafter, the coil component, the circuit board, and the power supply device according to the embodiment will be specifically described, with reference to the drawings as necessary. In the drawings, the same reference characters denote the same elements.

Embodiment 1

Figure 1:
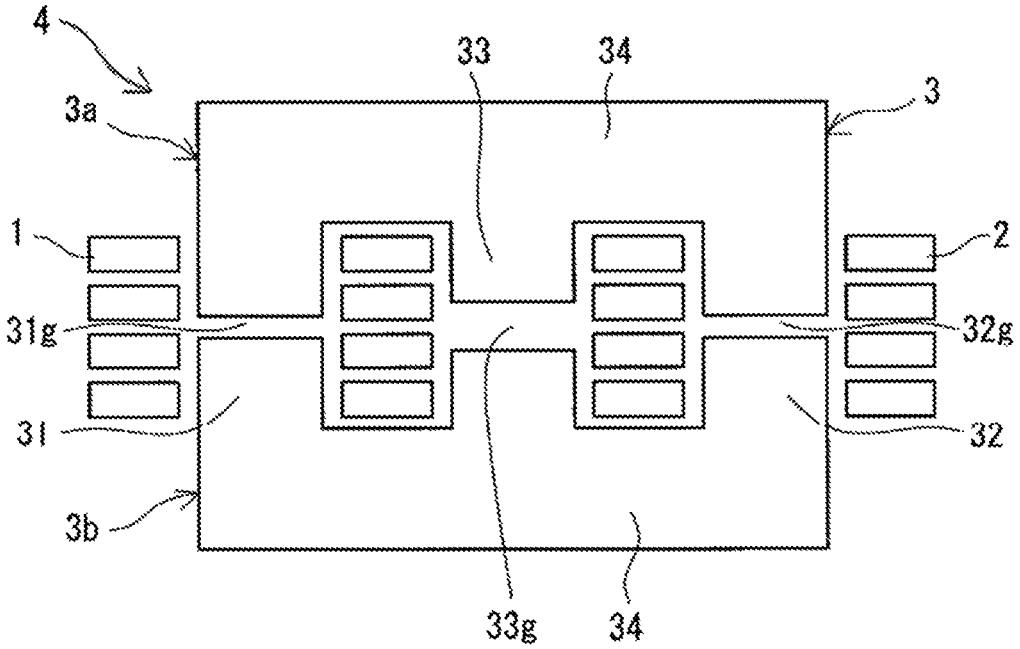
FIG. 1 is a schematic configuration diagram showing a coil component of embodiment 1.
Figure 2:
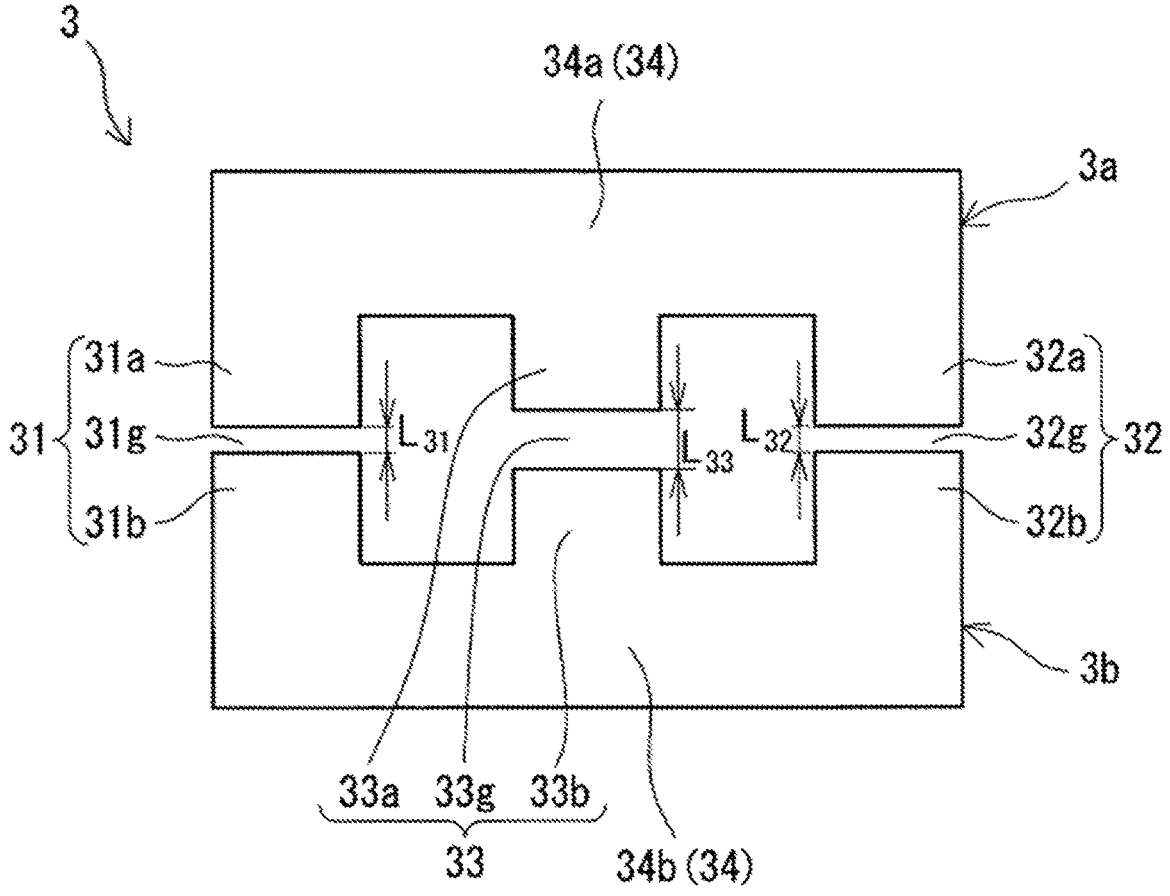
FIG. 2 is a schematic configuration diagram showing an example of a magnetic core included in the coil component of embodiment 1.
Figure 3:
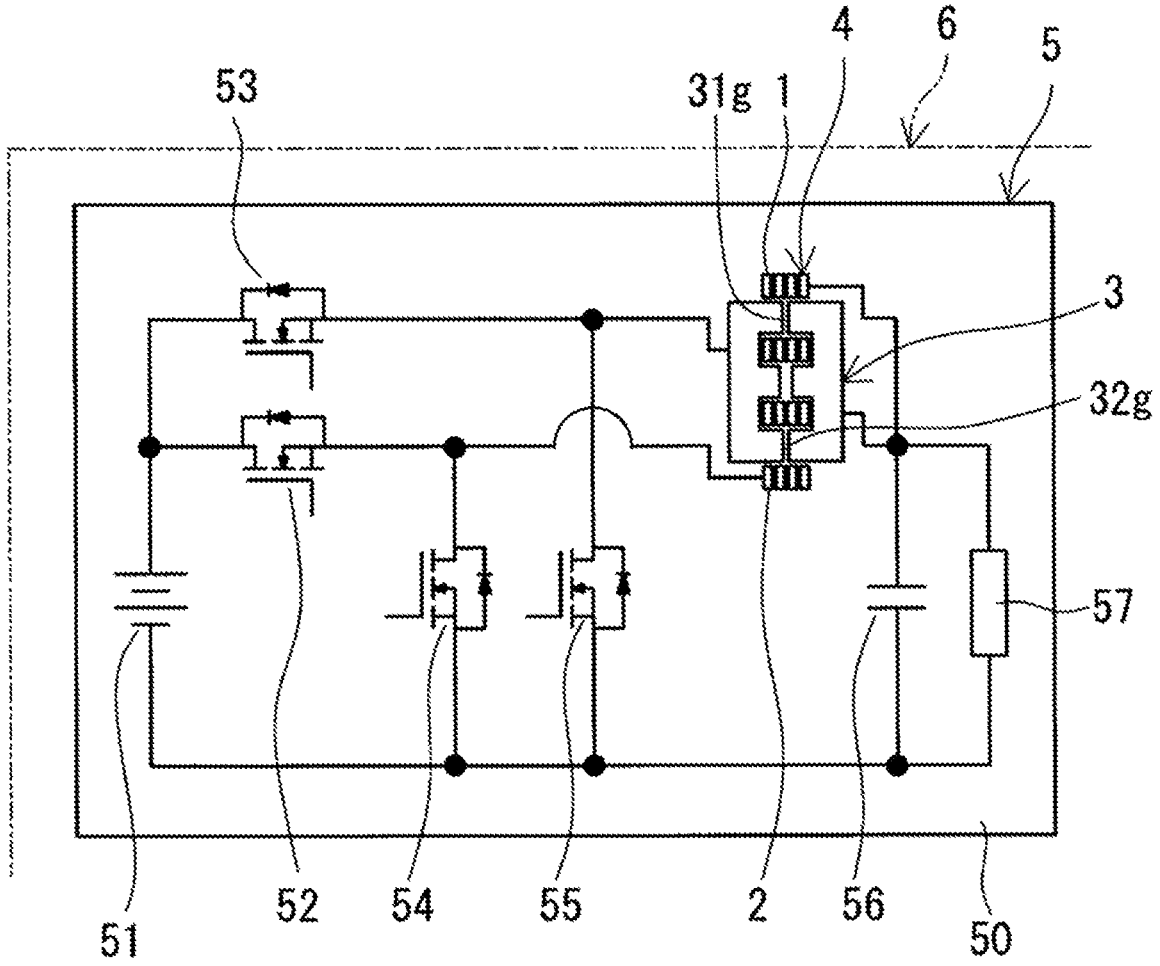
FIG. 3 is a schematic configuration diagram showing an example of a circuit board of embodiment 1 by an equivalent circuit.

With reference to FIG. 1 to FIG. 3, a coil component 4, a circuit board 5, and a power supply device 6 of embodiment 1 will be described. In FIG. 3, the outline of the circuit board 5 is shown by an equivalent circuit, and major circuit components other than the coil component 4 are indicated by circuit symbols. In addition, in FIG. 3, the coil component 4 is shown largely and in an emphasized manner relative to a board body 50, for facilitating the understanding.

Entire Configuration

The coil component 4 of embodiment 1 is used for two-phase transformer coupling, and as shown in FIG. 1, includes a first coil 1, a second coil 2, and a magnetic core 3 at which the first coil 1 and the second coil 2 are provided. That is, in the coil component 4, two independent coils 1, 2 are provided at one magnetic core 3. The magnetic core 3 includes a first magnetic leg 31 at which the first coil 1 is provided, a second magnetic leg 32 at which the second coil 2 is provided, a central leg portion 33 interposed between the first magnetic leg 31 and the second magnetic leg 32, and a pair of connection portions 34 connecting the first magnetic leg 31, the central leg portion 33, and the second magnetic leg 32 in parallel. In the central leg portion 33, a main gap 33*g* is interposed. The second coil 2 is provided at the second magnetic leg 32 so as to cancel a magnetic flux generated by the first coil 1.

Further, in the coil component 4 of embodiment 1, the magnetic core 3 has gaps (first gap 31*g*, second gap 32*g*) also in the respective magnetic legs 31, 32, in addition to the main gap 33*g*. In addition, in the coil component 4, the coupling coefficient between the first coil 1 and the second coil 2 is not less than 0.7. Hereinafter, each constituent member will be described.

Coils

The first coil 1 and the second coil 2 each include a cylindrical winding portion formed by winding a wire helically. A power supply 51 (FIG. 3) and the like are connected via a wiring pattern and the like to ends of wires extending from the winding portions.

As the wires forming the coils 1, 2, coated wires obtained by forming insulating coats around the outer surfaces of conductor wires can be favorably used. Examples of the material forming the conductor wires include copper, aluminum, and an alloy thereof. The material forming the insulating coats is, for example, resin such as polyamide-imide called enamel. In this example, the wires forming the coils 1, 2 are coated rectangular wires having the same specifications (material, width, thickness, sectional area, and the like). In addition, the coils 1, 2 in this example are cylindrical edgewise coils having the same specifications (winding diameter, the number of winding turns, normal length, and the like).

The specifications of the wires and the specifications of the winding portions can be selected as appropriate. As another example of the wires, a known wire material used for coils, e.g., a rectangular wire, a round wire, a coated round wire, or a litz wire can be used. As in this example, using a rectangular wire as the conductor wire facilitates increase in the space factor and facilitates formation of a small-sized coil. In addition, the coil formed by using a rectangular wire as the conductor wire is more excellent in shape keeping property than a litz wire, and can retain the hollow shape even if the coil is manufactured independently of the magnetic core 3. Further, using a cylindrical edgewise coil as in this example facilitates manufacturing even in a case where the winding diameter is comparatively small, and thus provides excellent manufacturability.

Magnetic Core (Magnetic core)

The magnetic core 3 is a magnetic member including a soft magnetic material and forming a closed magnetic path. The magnetic core 3 includes the columnar first magnetic leg 31 at which the winding portion of the first coil 1 is provided, the columnar second magnetic leg 32 at which the winding portion of the second coil 2 is provided, the columnar central leg portion 33 interposed between both magnetic legs 31, 32 arranged side by side so as to be separated from each other, and the pair of plate-shaped connection portions 34 sandwiching the first magnetic leg 31, the central leg portion 33, and the second magnetic leg 32 arranged in this order, and connecting these. The magnetic core 3 included in the coil component 4 of embodiment 1 has the main gap 33*g* interposed in the central leg portion 33, the first gap 31*g* interposed in the first magnetic leg 31, and the second gap 32*g* interposed in the second magnetic leg 32. In this example, as shown in FIG. 2, a gap length $L_{31}$ of the first gap 31*g* and a gap length $L_{32}$ of the second gap 32*g* are shorter than a gap length $L_{33}$ of the main gap 33*g*.

The magnetic core 3 in this example is formed by combining a pair of E-shaped divided core pieces 3*a*, 3*b* such that their opening portions face each other, as shown in FIG. 2. In particular, in the coil component 4 of embodiment 1, since the gaps 31*g*, 32*g*, 33*g* are respectively provided in the magnetic legs 31, 32 and the central leg portion 33, the divided core pieces 3*a*, 3*b* are combined so as to be spaced from each other in accordance with the gap lengths. Since the magnetic core 3 is formed by combining the plurality of divided core pieces 3*a*, 3*b*, the above space can be easily provided and thus the gaps 31*g*, 32*g*, 33*g* can be provided. In a case where the coils 1, 2 are coils such as edgewise coils that can be manufactured independently of the magnetic core 3 as described above, the coils 1, 2 and the divided core pieces 3*a*, 3*b* can be easily combined with each other. If the number of divided core pieces is two as in this example, the number of combined components can be decreased. This results in excellent manufacturability of the coil component 4.

In this example, the divided core pieces 3*a*, 3*b* have the same shape and the same size. Therefore, in the following description, one divided core piece 3*a* will be described as a representative. For the other divided core piece 3*b*, the following description can be applied by replacing reference character "a" with "b". Forming both divided core pieces 3*a*, 3*b* in the same shape and the same size provides such effects that, for example, when the divided core pieces 3*a*, 3*b* are molded by a mold, they can be molded by the same mold, leading to excellent mass productivity, and they can be easily combined, leading to excellent assembly operability.

The divided core piece 3*a* includes two magnetic leg pieces 31*a*, 32*a* forming parts of the magnetic legs 31, 32, a central leg piece 33*a* interposed between the two magnetic leg pieces 31*a*, 32*a* and forming a part of the central leg portion 33, and one connection portion 34*a* supporting the two magnetic leg pieces 31*a*, 32*a* and the central leg piece 33*a*. The two magnetic leg pieces 31*a*, 32*a* and the central leg piece 33*a* protrude from the inner surface of the connection portion 34*a*. In this example, the protrusion heights of both magnetic leg pieces 31*a*, 32*a* are substantially equal to each other, and slightly greater than the protrusion height of the central leg piece 33*a*. Therefore, when both divided core pieces 3*a*, 3*b* are combined with each other such that predetermined spaces are formed between the magnetic leg pieces 31*a*, 31*b* and between the magnetic leg pieces 32*a*, 32*b*, a larger space than the above spaces between the magnetic leg pieces can be provided between the central leg pieces 33*a*, 33*b* of both divided core pieces 3*a*, 3*b*. This larger space is defined as the main gap 33g. The space between the two magnetic leg pieces 31a, 31b forming the first magnetic leg 31 is defined as the first gap 31g. The space between the two magnetic leg pieces 32a, 32b forming the second magnetic leg 32 is defined as the second gap 32g.

The magnetic legs 31, 32 (magnetic leg pieces 31a, 32a, 31b, 32b) and the central leg portion 33 (central leg pieces 33a, 33b) may have appropriate columnar shapes such as a cylindrical shape and a rectangular parallelepiped shape, for example. The magnetic legs 31, 32 may have shapes not similar to the inner circumference shapes of the coils 1, 2, but if they have shapes similar to the inner circumference shapes of the coils 1, 2 (in this example, have cylindrical shapes), the coils 1, 2 and the magnetic legs 31, 32 can be easily combined with each other, leading to excel lent manufacturability of the coil component 4. The connection portions 34 (34a, 34b) may have rectangular plate shapes, for example. The shape of the magnetic core 3 (shapes of the magnetic legs 31, 32, the central leg portion 33, and the connection portion 34) can be selected as appropriate within such a range as to obtain a predetermined magnetic path sectional area.

Gaps

The coil component 4 has the main gap 33g in the central leg portion 33 at which both coils 1, 2 are not provided, in the magnetic core 3. In the magnetic core 3 as described above, in a case where the coil component 4 is used for two-phase transformer coupling, magnetic saturation due to a leakage magnetic flux based on each coil 1, 2 is less likely to occur. The coil component 4 also has the gaps 31g, 32g in the magnetic legs 31, 32 at which the coils 1, 2 are provided, in the magnetic core 3. In the magnetic core 3 as described above, in a case where the coil component 4 is used for two-phase transformer coupling and a difference occurs between currents flowing through both coils 1, 2, magnetic saturation due to a magnetic flux based on the current difference is less likely to occur.

The gap length $L_{33}$ of the main gap 33g is set as appropriate so as to reduce magnetic saturation due to a leakage magnetic flux as described above. The gap length $L_{31}$ of the first gap 31g and the gap length $L_{32}$ of the second gap 32g are set within such a range as to reduce magnetic saturation due to the current difference as described above and prevent the coupling coefficient between both coils 1, 2 from being excessively reduced due to the gaps 31g, 32g. This is because reduction in the coupling coefficient leads to increase in ripple current. Increase in ripple current can lead to increase in loss of semiconductor elements used for switches 52 to 55 (FIG. 3), increase in the heat generation amount in the capacitor 56 (FIG. 3), and thermal damage thereof, in a two-phase transformer-coupled voltage transforming circuit or the like. Accordingly, the gap lengths $L_{31}$, $L_{32}$ are set to values in such a range that increase in ripple current is small, specifically, such values that cause the coupling coefficient to be not less than 0.7. Such gap lengths $L_{31}$, $L_{32}$ may be shorter than the gap length $L_{33}$ of the main gap 33g. For example, the gap lengths $L_{31}$, $L_{32}$ are set to be not greater than 10% of the gap length $L_{33}$ of the main gap 33g. As the gap lengths $L_{31}$, $L_{32}$ decrease, the coupling coefficient can be more readily increased and also increase in ripple current can be more readily reduced. From the standpoint of increasing the coupling coefficient, the gap lengths $L_{31}$, $L_{32}$ are preferably not greater than 9.5% of the gap length $L_{33}$ of the main gap 33g, and further preferably not greater than 9%, 8.5%, or 8% thereof. On the other hand, as the gap lengths $L_{31}$, $L_{32}$ increase, magnetic saturation due to the current difference as described above can be more readily reduced. Therefore, for example, the gap lengths $L_{31}$, $L_{32}$ are set to be not less than 1% of the gap $L_{33}$ of the main gap 33g, and further, not less than 2% or 3% thereof.

The gap lengths L31, L32 may be different from each other. However, if they are substantially equal to each other as in this example, it becomes easy to cause a magnetic flux to uniformly flow through the magnetic legs 31, 32.

Besides, the gaps 31g, 32g may be provided to the magnetic core 3 so as to be located in the respective coils 1, 2, as shown in FIG. 1.

Arrangement of Coils

Since the coil component 4 of embodiment 1 is used for two-phase transformer coupling, the first coil 1 and the second coil 2 are mounted to the magnetic core 3 so as to mutually cancel magnetic fluxes generated by the respective coils 1, 2 during energization. In addition, currents are supplied to the coils 1, 2 so as to form such flow of magnetic fluxes.

Coupling Coefficient

In the coil component 4 of embodiment 1, although the magnetic core 3 has the gaps 31g, 32g in addition to the main gap 33g as described above, the coupling coefficient between both coils 1, 2 is not less than 0.7. Therefore, in a case of constructing, for example, a two-phase transformer-coupled voltage transforming circuit provided with the coil component 4, increase in ripple current is small and voltage transforming operation such as boost operation and step-down operation can be stably performed over a long period. As the coupling coefficient increases, increase in ripple current can be more readily reduced. From this standpoint, the coupling coefficient is preferably not less than 0.75 and further preferably not less than 0.78 or not less than 0.8. The gap lengths $L_{31}$, $L_{32}$ are set so that the coupling coefficient becomes not less than 0.7.

It is noted that the coupling coefficient is calculated from the following relational equation. Where the coupling coefficient is denoted by k, the self-inductance of the first coil 1 is denoted by L1, the self-inductance of the second coil 2 is denoted by L2, and the mutual inductance between both coils 1, 2 is denoted by M, the coupling coefficient k satisfies $k^2=M^2/(L1\times L2)$.

Using commercial simulation software or the like, correlation data between the coupling coefficient and ripple current, correlation data between the applied current value and the gap lengths $L_{31}$, $L_{32}$ for each coupling coefficient, and the like can be calculated in advance. By using the above correlation data, it is possible to easily select more preferable values of the coupling coefficient, the gap lengths $L_{31}$, $L_{32}$, the used current values, and the like in accordance with desired requirements.

Materials

As the magnetic core 3 (here, divided core pieces 3a, 3b), various types of cores made of known materials can be used. Examples thereof include a sintered body such as a ferrite core, a powder compacted body using powder of soft magnetic material, a molded body made of a complex material including resin and powder of soft magnetic material, and a stacked body formed by stacking soft magnetic sheet materials such as electromagnetic steel sheets.

At least one of the main gap 33g and the gaps 31g, 32g may be an air gap. For example, the coil component 4 may be provided with a shape retaining member (not shown) that can keep the combined state of the divided core pieces 3a, 3b such that the main gap 33g is an air gap and the gaps 31g, 32g partially include air gaps. At least one of the main gap 33g and the gaps 31g, 32g may include a gap material formed from a solid non-magnetic material. Examples of the non-magnetic material include a non-metal inorganic material such as alumina, and a non-metal organic material such as resin. As the gap material, various types such as a flat plate or a resin molded body having a predetermined shape may be used. The gap material may be fixed to the divided core pieces 3a, 3b by an adhesive agent or the like. One or two of the main gap 33g and the gaps 31g, 32g may be an air gap, and the others may include the gap materials. For example, the main gap 33g may be an air gap and the gaps 31g, 32g may include the gap materials. In this case, if the gap materials are materials having adhesion such as a double-sided tape or an adhesive agent, the gap materials can function as magnetic gaps and also as joining members for integrating the divided core pieces 3a, 3b. In a case where the magnetic leg pieces 31a, 31b and the magnetic leg pieces 32a, 32b of the divided core pieces 3a, 3b are joined to each other by the gap materials serving also as the joining members as described above, the strength of the assembled magnetic core 3 can be enhanced and the shape keeping property is improved. The thickness of a double-sided tape or an adhesive agent layer can be easily reduced, and therefore a double-sided tape or an adhesive agent layer can be favorably used for the gaps 31g, 32g that may be comparatively small magnetic gaps.

Applications

The coil component 4 of embodiment 1 can be used as one of components of the circuit board 5 for making two-phase transformer coupling. The circuit board 5 can be used as one of components of the power supply device 6 for making two-phase transformer coupling. In FIG. 3, a state in which a part of the circuit board 5 is stored in a case of the power supply device 6 is shown partially and conceptually. The circuit board 5 may be a DC-DC converter forming a two-phase transformer-coupled boost/step-down chopper circuit, as an example. The power supply device 6 including such a circuit board 5 can be used as a converter mounted on a vehicle such as a hybrid vehicle, an electric vehicle, or a fuel cell vehicle, for example.

Circuit Board

The circuit board 5 of embodiment 1 includes the coil component 4 of embodiment 1, as shown in FIG. 3. Typically, the circuit board 5 includes various circuit components including the coil component 4, the board body 50 on which these circuit components are mounted, and a wiring pattern (not shown) provided on the board body 50 and connected to the circuit components. Such circuit components are provided in accordance with the intended use of the circuit board 5, and are typically connected via the wiring pattern. The ends of wires of the coils 1, 2 in the coil component 4 are connected to the wiring pattern. For the connection, a known connection method such as soldering or screwing can be used.

FIG. 3 shows an example in which the circuit board 5 is a DC-DC converter forming a two-phase transformer-coupled boost/step-down chopper circuit. The circuit board 5 includes, as the circuit components, a DC power supply 51, switches 52 to 55, a capacitor 56, a load 57, and the like, in addition to the coil component 4. As the switches 52 to 55, semiconductor elements such as MOSFETs shown as an example in FIG. 3 are used. The circuit board 5 includes a control circuit (not shown) for performing open/close control of the switches 52 to 55, and the like. Through open/close control of the switches 52 to 55 by the control circuit, the circuit board 5 can lower the voltage of the power supply 51 and output the lowered voltage to the load 57 (step-down operation). On the other hand, in a case where input and output are inverted, namely, in a case where the load 57 shown in FIG. 3 is replaced with a power supply and the power supply 51 is replaced with a load, the control manner for the switches 52 to 55 is changed so that the power supply voltage can be boosted and outputted to the load (boost operation). As the basic structure, materials, and the like of the circuit board 5, those from known art can be used, and therefore the detailed description thereof is omitted.

Power Supply Device

The power supply device 6 of embodiment 1 includes the circuit board 5 of embodiment 1. FIG. 3 shows an example in which the power supply device 6 includes the circuit board 5 that is a DC-DC converter forming a two-phase transformer-coupled boost/step-down chopper circuit as described above. For the other configurations in the power supply device 6, known configurations can be used and the detailed description thereof is omitted.

Principal Effects

While the coil component 4 of embodiment 1 has a simple structure in which, besides the main gap 33g, the gaps 31g, 32g are also provided in the respective magnetic legs 31, 32 at which the coils 1, 2 are provided, even if there is a great difference between currents flowing through the respective coils 1, 2, magnetic saturation due to the current difference is less likely to occur. In addition, in the coil component 4 of embodiment 1, the gaps 31g, 32g are set within such a range that causes the coupling coefficient between both coils 1, 2 to be not less than 0.7. Thus, increase in ripple current can be reduced. This effect will be specifically described on the basis of the test examples below.

In a case where the circuit board 5 of embodiment 1 including the coil component 4 of embodiment 1 and the power supply device 6 of embodiment 1 including the circuit board 5 are used for, for example, a two-phase transformer-coupled boost/step-down circuit or a converter including this circuit, increase in ripple current is reduced and magnetic saturation based on the current difference described above is less likely to occur. Therefore, it is possible to favorably perform predetermined voltage transforming operation over a long period.

In addition, since the gaps 31g, 32g can be made comparatively small as described above, the magnetic core 3 including the gaps 31g, 32g can be readily downsized. Accordingly, the size of the coil component 4 of embodiment 1 is small.

TEST EXAMPLE 1

Coil components to be used for two-phase transformer coupling were manufactured, and ripple current was investigated while the coupling coefficient was changed. A result thereof is shown in FIG. 4.

Here, the coil component 400 shown in FIG. 7 is used as a basic configuration. That is, a coil component including a first coil, a second coil, and a magnetic core having a first magnetic leg, a second magnetic leg, a central leg portion including a main gap, and connection portions, is used as a basic configuration, and further, gaps are provided in the first magnetic leg and the second magnetic leg. Hereinafter, gaps provided to the first magnetic leg and the second magnetic leg are referred to as additional gaps. Here, the coupling coefficient is changed by changing the gap lengths of the additional gaps. Ripple current when a predetermined current flowed through each coil component having a different coupling coefficient was measured using a commercial current probe.

Figure 4:
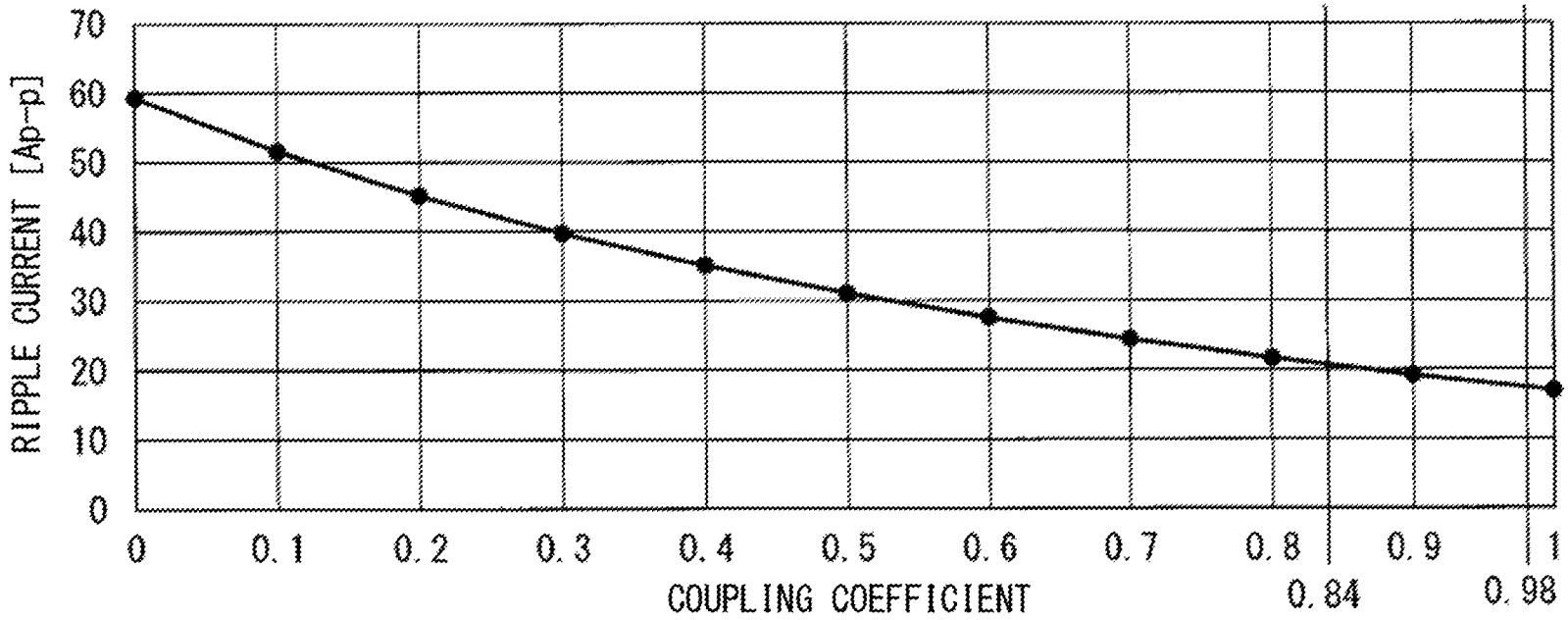
FIG. 4 is a graph showing the relationship between a coupling coefficient and ripple current.

FIG. 4 is a graph showing the relationship between the coupling coefficient and ripple current [A p-p]. The horizontal axis indicates the coupling coefficient, and the vertical axis indicates ripple current ([A p-p], peak-to-peak value). As shown in FIG. 4, it is found that, as the coupling coefficient approaches 1, the ripple current becomes smaller. The ripple current when the coupling coefficient is 0.7 is 1.44 times the ripple current when the coupling coefficient is 1, and thus increase in the ripple current is less than 1.5 times as compared to when the coupling coefficient is 1. When the coupling coefficient is not less than 0.7, increase in the ripple current is further reduced, i.e., 1.4 times or less, and further, 1.3 times or less, and then 1.2 times or less. This shows that providing the additional gaps within such a range that causes the coupling coefficient to be not less than 0.7 reduces increase in ripple current.

TEST EXAMPLE 2

Coil components to be used for two-phase transformer coupling were manufactured, the coil components including the one having only a main gap, and the one having both of a main gap and additional gaps. Then, the magnetic saturation state was investigated while the applied current value was changed.

Sample No. 1 is the coil component having both of the main gap and the additional gaps in the magnetic core, and corresponds to the coil component 4 of embodiment 1 shown in FIG. 1.

Sample No. 100 is the coil component having only the main gap without having additional gaps, and corresponds to the coil component 400 shown in FIG. 7.

The specifications of the coil components of both samples are substantially the same except for presence/absence of the additional gaps.

The gap lengths of the main gaps of both samples are 2 mm.

In sample No. 1, the gap lengths of the first gap and the second gap which are the additional gaps are 0.13 mm (6.5% of the main gap). The total gap length of the additional gaps is 0.26 mm, which is shorter than the gap length of the main gap.

The coupling coefficient of sample No. 1 is about 0.84. In sample No. 1, increase in ripple current as compared to a case where the coupling coefficient is 1 is about 1.2 times or less.

The coupling coefficient of sample No. 100 is about 0.98.

In this test, DC currents were varied and supplied to the first coil and the second coil. The current waveforms at this time were measured using a commercial current probe, and presence/absence of magnetic saturation was investigated. The average value of the DC currents supplied to the coils was selected in a range of 15 A to 100 A. Here, a current difference of about 5 A was provided between the first coil and the second coil. For example, in the condition that the average value of the DC currents is 80 A, the actual DC current flowing through the first coil is about 77.5 A, and the actual DC current flowing through the second coil is about 82.5 A. With respect to such a current difference, robustness is compared. For sample No. 1 and sample No. 100, the selected average value [A] of DC currents and the state of magnetic saturation are shown in Table 1 and Table 2.

Figure 5:
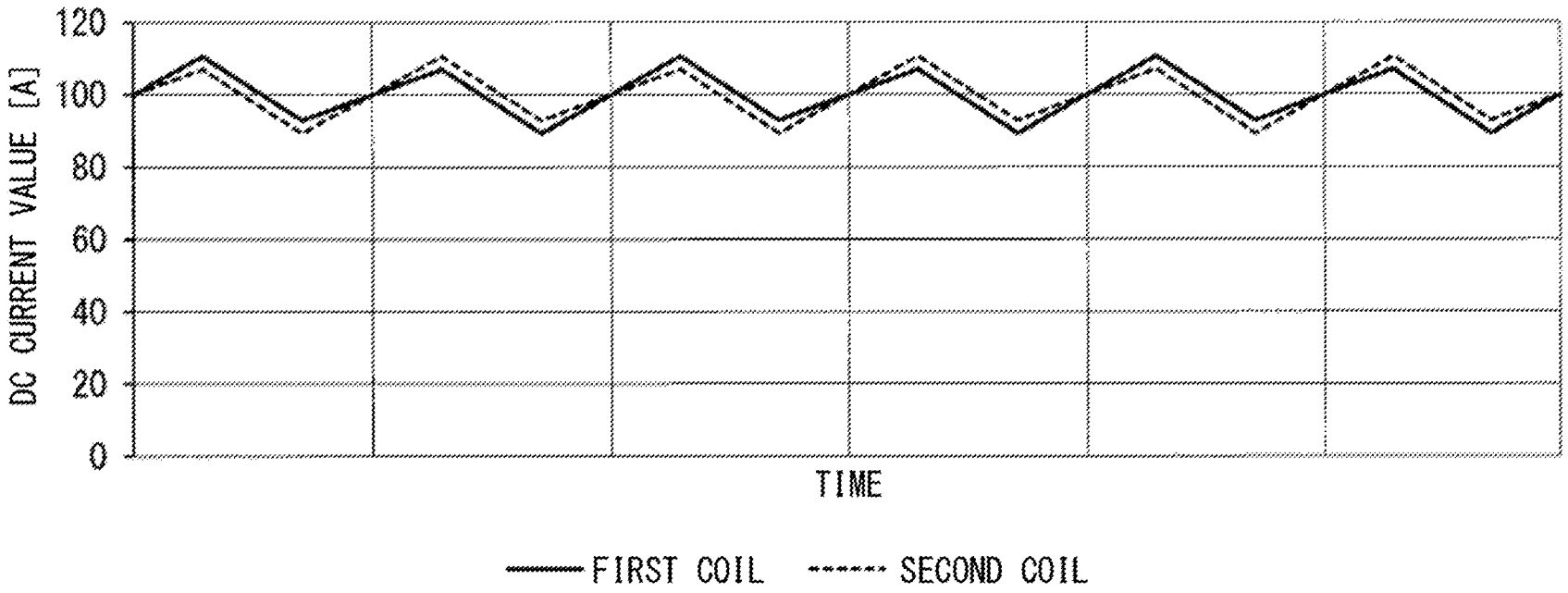
FIG. 5 is a graph showing the waveforms of currents flowing through respective coils in a coil component of sample No. 1 in test example 2.
Figure 6:
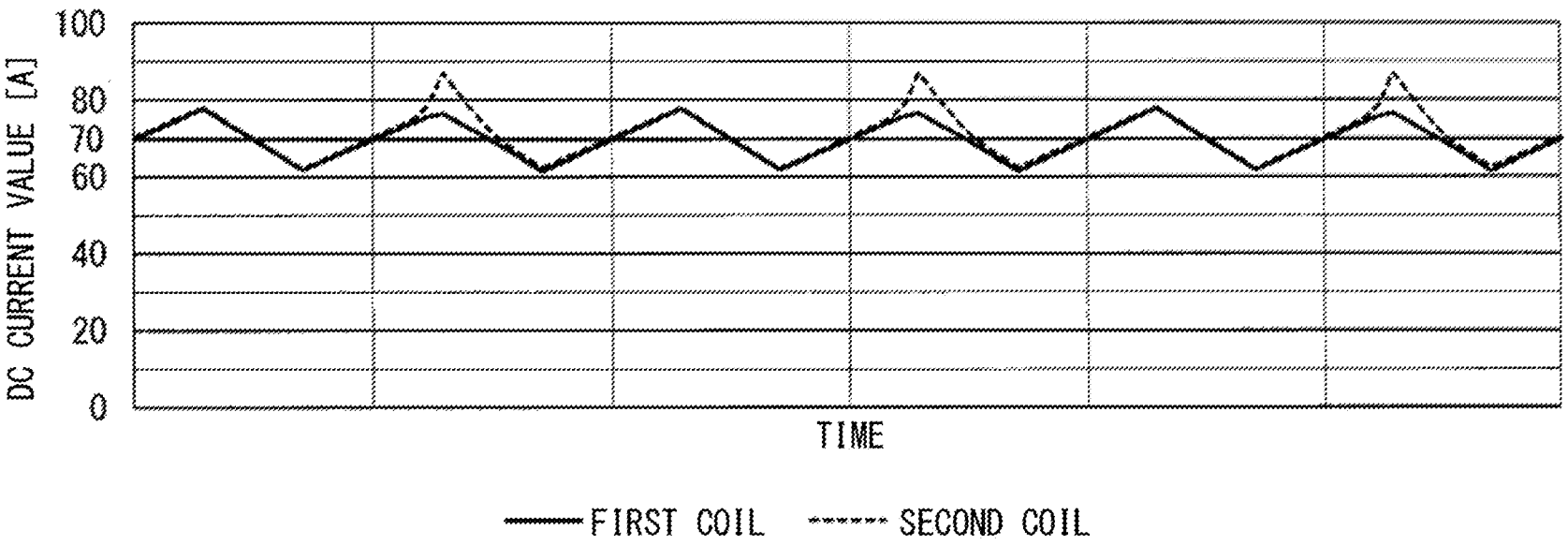
FIG. 6 is a graph showing the waveforms of currents flowing through respective coils in a coil component of sample No. 100 in test example 2.

For sample No. 1, FIG. 5 shows the current waveform of the first coil and the current waveform of the second coil when the DC current is 100 A. For sample No. 100, FIG. 6 shows the current waveform of the first coil and the current waveform of the second coil when the DC current is 70 A. In the graphs of the current waveforms shown in FIG. 5 and FIG. 6, the horizontal axis indicates time (the scale interval is 5 microseconds=5 ≈S ), and the vertical axis indicates the DC current value [A].

In this test, different measurement temperatures were used for sample No. 1 and sample No. 100. The measurement temperature for sample No. 1 including both of the main gap and the additional gaps was 130增 . The measurement temperature for sample No. 100 including only the main gap was 60增 . It can be said that, as the measurement temperature increases, magnetic saturation is more likely to occur.

TABLE 1

| Temperature | DC current value [A] | Magnetic saturation |
|---|---|---|
| 130增 | 15 | None |
| 130增 | 30 | None |
| 130增 | 50 | None |
| 130增 | 60 | None |
| 130增 | 70 | None |
| 130增 | 80 | None |
| 130增 | 90 | None |
| 130增 | 100 | None |

TABLE 2

| Temperature | DC current value [A] | Magnetic saturation |
|---|---|---|
| 60增 | 15 | None |
| 60增 | 30 | None |
| 60增 | 50 | None |
| 60增 | 60 | None |
| 60增 | 70 | Slightly saturated |
| 60增 | 80 | Saturated |

As shown in Table 1, it is found that the coil component of sample No. 1 having both of the main gap and the additional gaps is less likely to cause magnetic saturation even when a large current such as 100 A is supplied. In particular, it is found that even in the condition such as 130 增 in which magnetic saturation is likely to occur, the coil component of sample No. 1 is less likely to cause magnetic saturation. As shown in FIG. 5, although the current waveform of the first coil and the current waveform of the second coil are slightly separated from each other, the current waveforms of both coils have regular shapes, and a local peak or the like is not present. It is noted that the above separation between the currents occurs due to the coupling coefficient being low to a certain extent.

As shown in Table 2, in the coil component of sample No. 100 having only the main gap, in spite of the condition in which the measurement temperature is low at 60增 and magnetic saturation is less likely to occur, magnetic saturation occurs when the current value is 70 A. As shown in FIG.

6, the current waveform of the first coil and the current waveform of the second coil generally overlap each other and the number of separation parts is small, but an extremely great separation part repeatedly occurs at predetermined time intervals. The great separation part is a part around the point where the current waveform of the second coil indicated by a broken line is separated from the current waveform of the first coil indicated by a solid line and has the maximum current value close to 90 A. Occurrence of the great separation part means that magnetic saturation occurs. Accordingly, it can be said that, in the coil component having only the main gap without having the additional gaps, the difference between currents flowing through the first coil and the second coil is less likely to be absorbed and magnetic saturation is likely to occur.

From the above test, it has been shown that magnetic saturation can be reduced by providing gaps (additional gaps) to the respective magnetic legs at which the coils are provided, in addition to the main gap, in the coil component used for two-phase transformer coupling.

From the above test example 1 and test example 2, it has been shown that providing the additional gaps to the respective magnetic legs as described above within such a range that causes the coupling coefficient to be not less than 0.7 can reduce increase in the ripple current and can make magnetic saturation less likely to occur. If the coil component as described above is used for, for example, a circuit board including a voltage transforming circuit such as two-phase transformer-coupled boost/step-down circuit, or a power supply device including such a circuit board, increase in ripple current is reduced and magnetic saturation is less likely to occur, and therefore it is expected that predetermined voltage transforming operation such as boost operation or step-down operation can be favorably performed over a long period.

The present invention is not limited to the above examples, but is defined by the scope of claims and is intended to include meaning equivalent to the scope of claims and all modifications within the scope.

For example, at least one of the following modifications can be made.

(1) The shapes or the division number of the divided core pieces may be modified. For example, one divided core piece is formed in an I shape (rectangular parallelepiped shape), and the other divided core piece is formed in an E shape. In addition, the first magnetic leg and the second magnetic leg of the E-shaped core piece are made longer than the central leg portion in accordance with the gap lengths, and then the I-shaped core piece is combined therewith. Thus, a coil component in which the gap lengths $L_{31}$, $L_{32}$ are shorter than the gap length $L1_{33}$ of the main gap can be constructed.

(2) The size of the first gap 31*g* formed in the first magnetic leg 31 and the size of the second gap 32*g* formed in the second magnetic leg 32 may be made different from each other.

(3) An interposing member made of an insulating material may be provided between the magnetic core and each of the first coil and the second coil, an insulating coating material covering each coil may be provided, or an insulating coating material covering the magnetic core may be provided. Such a modification can enhance insulation property between each coil and the magnetic core.

(4) The circuit board or the power supply device may be configured to perform only boost operation or perform only step-down operation.

It is noted that the coil component used for two-phase transformer coupling is, in other words, a coupling inductor, for example, and can be expressed as follows.

A coupling inductor having a first coil (1) and a second coil (2) provided at a magnetic core (3) so as to form two-phase transformer coupling, wherein the magnetic core (3) includes a first magnetic leg (31) being a core leg portion at which the first coil (1) is provided, the first magnetic leg (31) having a first gap (31*g*) at a midway part therein, a second magnetic leg (32) being a core leg portion at which the second coil (2) is provided, the second magnetic leg (32) having a second gap (32*g*) at a midway part therein, a central leg portion (33) located between the first magnetic leg (31) and the second magnetic leg (32), the central leg portion (33) having a main gap (33*g*) at a midway part therein, and a pair of connection portions (34 (34*a*, 34*b*)) each connecting corresponding leg end portions of the first magnetic leg (31), the central leg portion (33), and the second magnetic leg (32) in parallel, and a coupling coefficient between the first coil (1) and the second coil (2) is not less than 0.7.

REFERENCE SIGNS LIST

1, 101 first coil
2, 102 second coil
3, 300 magnetic core
3*a*, 3*b* divided core piece
31, 310 first magnetic leg
32, 320 second magnetic leg
33, 330 central leg portion
34, 34*a*, 34*b*, 340 connection portion
31*g* first gap
32*g* second gap
33*g* main gap
31*a*, 32*a*, 31*b*, 32*b* magnetic leg piece
33*a*, 33*b* central leg piece
330*g* gap
4, 400 coil component
5 circuit board
50 board body
51 power supply
52, 53, 54, 55 switch
56 capacitor
57 load
6 power supply device

The invention claimed is:

1. A coil component used for two-phase transformer coupling, the coil component comprising:

a first coil and a second coil; and a magnetic core at which the first coil and the second coil are provided, wherein the magnetic core comprises:

a first magnetic leg at which the first coil is provided, the first magnetic leg comprising first divided core pieces;

a second magnetic leg at which the second coil is provided, the second magnetic leg comprising second divided core pieces;

a central leg portion interposed between the first magnetic leg and the second magnetic leg;

a pair of connection portions connecting the first magnetic leg, the central leg portion, and the second magnetic leg in parallel;

a main gap interposed in the central leg portion;

a first gap interposed in the first magnetic leg; and a second gap interposed in the second magnetic leg, the main gap, the first gap, and the second gap have a relationship where a coupling coefficient between the first coil and the second coil is greater than 0.7, the first divided core pieces are spaced from each other in accordance with a first gap length, the second divided core pieces are spaced from each other in accordance with a second gap length, and each of the first gap length and the second gap length is shorter than a gap length of the main gap.

2. The coil component according to claim 1, wherein each of the gap length of the first gap and the gap length of the second gap is not greater than 10% of the gap length of the main gap.

3. A circuit board comprising the coil component according to claim 1.

4. A power supply device comprising:

the circuit board according to claim 3.

5. A coil component comprising:

a first coil; and a second coil provided at a magnetic core so as to form two-phase transformer coupling, wherein the magnetic core comprises:

a first magnetic leg comprising first divided core pieces, the first magnetic leg being a core leg portion at which the first coil is provided, and the first magnetic leg having a first gap at a midway part therein;

a second magnetic leg comprising second divided core pieces, the second magnetic leg being a core leg portion at which the second coil is provided, and the second magnetic leg having a second gap at a midway part therein;

a central leg portion located between the first magnetic leg and the second magnetic leg, the central leg portion having a main gap at a midway part therein; and a pair of connection portions each connecting corresponding leg end portions of the first magnetic leg, the central leg portion, and the second magnetic leg in parallel, the main gap, the first gap, and the second gap have a relationship where a coupling coefficient between the first coil and the second coil is greater than 0.7, the first divided core pieces are spaced from each other in accordance with a first gap length, the second divided core pieces are spaced from each other in accordance with a second gap length, and each of the first gap length and the second gap length is shorter than a gap length of the main gap.

6. A circuit board comprising:

the coil component according to claim 1.

7. A power supply device comprising:

the circuit board according to claim 6.

8. A circuit board comprising:

the coil component according to claim 2.

9. A power supply device comprising:

the circuit board according to claim 8.

* * * * *